US006305903B1

(12) United States Patent
Semmler et al.

(10) Patent No.: US 6,305,903 B1
(45) Date of Patent: Oct. 23, 2001

(54) COOLED VANE FOR GAS TURBINE

(75) Inventors: Klaus Semmler; Bernhard Weigand, both of Lauchringen (DE)

(73) Assignee: Asea Brown Boveri AG, Baden (CH)

( * ) Notice: Subject to any disclaimer, the term of this patent is extended or adjusted under 35 U.S.C. 154(b) by 0 days.

(21) Appl. No.: 09/379,465

(22) Filed: Aug. 24, 1999

(51) Int. Cl.[7] ..... F01D 5/08
(52) U.S. Cl. ..... 416/97 R
(58) Field of Search ..... 415/115, 116, 415/176, 178; 416/97 R, 96 A

(56) References Cited

U.S. PATENT DOCUMENTS

| | | | | |
|---|---|---|---|---|
| 4,203,706 | * | 5/1980 | Hess | 416/96 A |
| 5,176,499 | * | 1/1993 | Damlis et al. | 416/97 R |
| 5,395,212 | * | 3/1995 | Anzai et al. | 416/97 R |
| 5,498,133 | | 3/1996 | Lee . | |
| 5,720,431 | * | 2/1998 | Sellers et al. | 416/97 R |
| 5,975,851 | * | 11/1999 | Liang | 416/97 R |
| 6,056,505 | * | 5/2000 | Cunha et al. | 416/97 R |
| 6,102,658 | * | 8/2000 | Kvasnak et al. | 416/97 R |
| 6,126,397 | * | 10/2000 | Kvasnak et al. | 416/97 R |

FOREIGN PATENT DOCUMENTS

| | | |
|---|---|---|
| 3122484 | 3/1982 | (DE) . |
| 0541207 | 5/1993 | (EP) . |
| 0 742 347 | 11/1996 | (EP) . |
| 0742347 | 11/1996 | (EP) . |
| 1050723 | 8/1963 | (GB) . |
| 1 255 360 | 11/1968 | (GB) . |
| 1 218 371 | 1/1971 | (GB) . |
| 2 038 957 | 12/1978 | (GB) . |
| 2 111 604 | 12/1982 | (GB) . |
| 2 112 869 | 12/1982 | (GB) . |
| 2112869 | 7/1983 | (GB) . |

* cited by examiner

*Primary Examiner*—Edward K. Look
*Assistant Examiner*—Ninh Nguyen
(74) *Attorney, Agent, or Firm*—Burns, Doane, Swecker & Mathis, L.L.P.

(57) ABSTRACT

A cooled vane for a gas turbine or similar device including a vane blade constructed of a suction side wall and a pressure side wall that are connected via a leading edge and a trailing edge with each other, which has an essentially radially extending cavity through which a cooling medium is capable of flowing. The vane blade has multiple cooling channels that, starting from the cavity, extend through a vane section adjoining the trailing edge and formed by sections of the suction side wall and the pressure side wall, and end at the trailing edge. A first row of cooling channels is associated with the suction side (SS) of the vane blade, and a second row of cooling channels is associated with the pressure side (DS) of the vane blade. The cooled vane has improved cooling efficiency and can be produced entirely with a casting process while complying with basic geometric conditions.

10 Claims, 4 Drawing Sheets

33
35
100
SS
DS
A
W
32
20
34

COOLED VANE FOR GAS TURBINE

FIELD OF THE INVENTION

The present invention relates to a cooled vane for a gas turbine or similar device.

BACKGROUND OF THE INVENTION

Such a vane is known, for example, from U.S. Pat. No. 5,498,133 on which the invention is based. It has a vane blade with a suction side and a pressure side wall that are connected via a leading edge and a trailing edge with each other. The walls define the profile form and enclose a cavity used for cooling purposes. The cavity extends essentially radially, and a cooling medium, usually air, flows through it. The flow through the cavity may, for example, be direct. Alternatively, the cavity may be provided with an insert, whereby the air is usually supplied radially to the insert. The perforation in the insert then causes the air to pass between the insert and the suction or pressure side wall and to be guided to the trailing edge.

In the area of the trailing edge, cooling channels are provided that originate from the cavity and end in the form of blow-out openings in the area of the trailing edge. They extend through a vane section that adjoins the trailing edge and is formed by the corresponding sections of the suction side and pressure side wall together. This means that the cooling medium is able to flow from the cavity through the trailing edge area and cool it before exiting at the trailing edge and being mixed into the process gas stream.

Such a cooling concept also can be realized in gas turbine vanes which are manufactured—as is currently preferred—by using casting processes. The cooling channels are hereby created using a core that must be removed from the component, i.e., from the vane, after the casting. When designing cooling channels, it must be noted in this connection that the corresponding cores also must be producable at a reasonable cost. Usually two- or multi-part core form tools into which the core material is pressed in the molten state are used for this purpose. After solidification, the core tool is opened, and the core can be removed. Since the core consists of a number of side-by-side, connected individual cores, a geometry must be chosen for the overall structure that permits an easy removal from the core form tool. Of importance in this connection is the so-called taper angle that causes a side contour of the individual channels originating from the dividing plane and extending backward at an angle. As a result, the cooling channels in vanes of this type usually were located so as to be located centered between the suction side and the pressure side.

In particular in the case of vanes with a thick trailing edge, this concept causes the cooling channels to be relatively far removed from the two outside walls, so that the cooling effect is very limited.

SUMMARY OF THE INVENTION

The invention attempts to avoid the described disadvantages. It is based on the objective of a cooled vane for a gas turbine or similar device of the initially mentioned type which permits an improved cooling effect in the area of the trailing edge and also can be manufactured at a reasonable cost, especially by using casting processes.

According to the invention this is realized in that in a cooled vane a first row of cooling channels is associated with the suction side and a second row of cooling channels is associated with the pressure side. Contrary to previous configurations in which the cooling channels were arranged near the vane center, the cooling channels are now shifted towards the outside walls. The reduced distance between the cooling channel and the outside wall achieves a higher cooling efficiency which manifests itself either through a reduced material temperature with an unchanged use of cooling medium, or which can be used to achieve the same material temperature with a reduced amount of cooling medium.

An improved component strength in the area of the trailing edge can be achieved if, according to a preferred embodiment, the cooling channels of the first row, when seen radially, are arranged laterally offset to the cooling channels of the second row. The reduction of the cross-section in the trailing edge area due to the applied cooling channels can be minimized in this way, so that in particular vanes with a narrow profile can be cooled optimally.

An arrangement that is optimal under this aspect is achieved if the local pitch of the first row and the local pitch of the second row are identical, and the cooling channels of the first row are in each case radially offset to the side from the cooling channels of the second row by an amount corresponding to half the local pitch. This results in a completely regular and symmetrical pattern of arrangement in which the cooling channels of one row each are arranged so as to be exactly centered opposite from the cooling channels of the other row.

According to a further embodiment of the invention, the sum of the maximum width of two opposing cooling channels is smaller than the local pitch at this point. This configuration permits a channel shape which allows the initially described core production in a casting process using a core form tool. The dividing plane of the core form tool hereby can be moved back and forth in each case between the two rows of cooling channels without undercutting and while preserving the required taper angle. The required taper angle and the distance of the two rows from the cooling channels determines the extra amount which must be added to the sum of the two maximum values for the widths of the cooling channels in order to determine the maximum value for the pitch of each row.

Cooling channels with a triangular or trapezoid design are preferred, since these shapes can be produced easily and at low cost.

Additional advantages in regard to the cooling effect are obtained if the cooling channels are constructed so that the maximum width in each case is oriented outward. As a result, the maximum width is oriented so as to directly adjoin the outside walls, that means it is oriented towards the suction side or pressure side, so that the cooling medium is to a greater degree supplied to these areas, i.e., those wall areas which are subject to the strongest thermal stresses. This type of orientation actually does require additional effort when producing the core form tool since the lateral contour progression of the core extends in the opposite direction to the taper angle of the dividing plane. But the increase in cooling efficiency that can be obtained by this more than makes up for this disadvantage.

It is also possible to reduce the maximum height of the cooling channels in relation to the previously centered channels, and to achieve in this way a balanced temperature distribution of the cooling medium and an increase in the speed inside the respective cooling channel. A value for the ratio of maximum height to maximum width from 1.5 to 1.0:1 was found to be the best.

The installation of turbulence generators, in particular in the form of ribs, which is provided in at least part of the cooling channels promises a further improvement. This improves the thermal transfer from the channel wall to the cooling medium, creating a further possibility for optimization.

An exact adjustment to the radial temperature distribution along the vane height is made possible in that the pitch and/or cross-section area of the cooling channels varies in the radial direction. Depending on the local heat input, the distance of the cooling channels of a row can be reduced, especially in the area of the vane center, where the thermal stress is highest. The cross-section area of the cooling channels in the central vane area also can be selected greater than in the area of the vane tip and the vane root.

Because of cost reasons it is advantageous that the vanes are produced as so-called cast vanes, whereby the cooling channels are directly molded on. This eliminates any necessary finishing, for example by drilling or eroding. For this purpose, the cooling channels are formed by a core that is removed after casting and solidification of the vane. For reasons of production technology it is preferable to use a single, contiguous core that can be produced in one piece in the casting process for all cooling channels of a vane. For this, a core form tool with a two- or multi-part design, as described above, is provided.

Alternatively, it is also possible to form the cooling channels by grooves in the suction and/or pressure side wall, and to seal them with a dividing body inserted tightly between the two walls. The dividing body assumes not only the function of the sealing termination of the individual cooling channels, but preferably also can be constructed as an insulator. For this purpose, high-temperature-resistant plastics, such as polytetrafluorethylene (PTFE), can be used.

BRIEF DESCRIPTION OF THE DRAWINGS

The present invention will now be described in more detail with reference to preferred embodiments of the invention, given only by way of example, and with reference to the accompanying drawings, in which.

DESCRIPTION OF THE PREFERRED EMBODIMENTS

Figure 1:
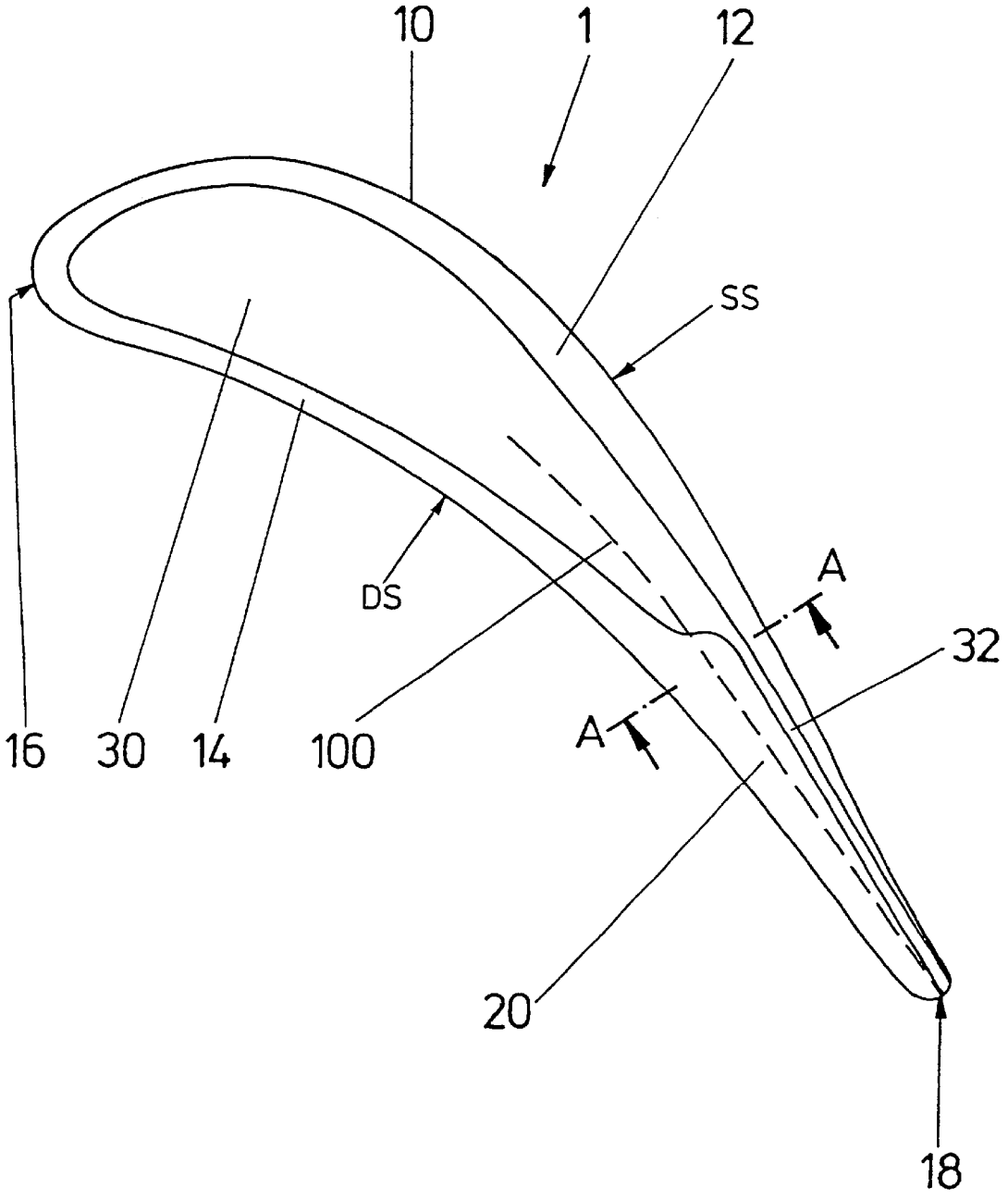
FIG. 1 shows a radial section of a vane.

The basic construction of the cooled vane 1 is shown in FIG. 1. The vane 1 has a vane blade 10 constructed of a suction side wall 12 and a pressure side wall 14. The suction side wall 12 and the pressure side wall 14 each are connected with each other, opposite from each other, via a leading edge 16 and a trailing edge 18. This creates a cavity 30 between the suction side wall 12 and the pressure side wall 14 that extends continuously in radial direction r (shown in FIGS. 2 and 3) through the vane blade 10, and through which a cooling medium, for example air, flows.

Starting from the cavity 30, cooling channels 32, 34 that extend through a vane section 20 and end at the trailing edge 18 are provided. The vane section 20 is associated with the trailing edge 18 and is formed together by corresponding sections of the suction side wall 12 and the pressure side wall 14.

The special characteristics of the invention are derived in particular from FIGS. 2 to 8 which show various design variations. They each represent a section along line A—A according to FIG. 1, whereby the cooling channel 32 shown in FIG. 1 represents all variations of FIGS. 2 to 8. But this cooling channel of FIG. 1 is neither true to form nor true to scale in regard to its actual representation.

Figure 2:
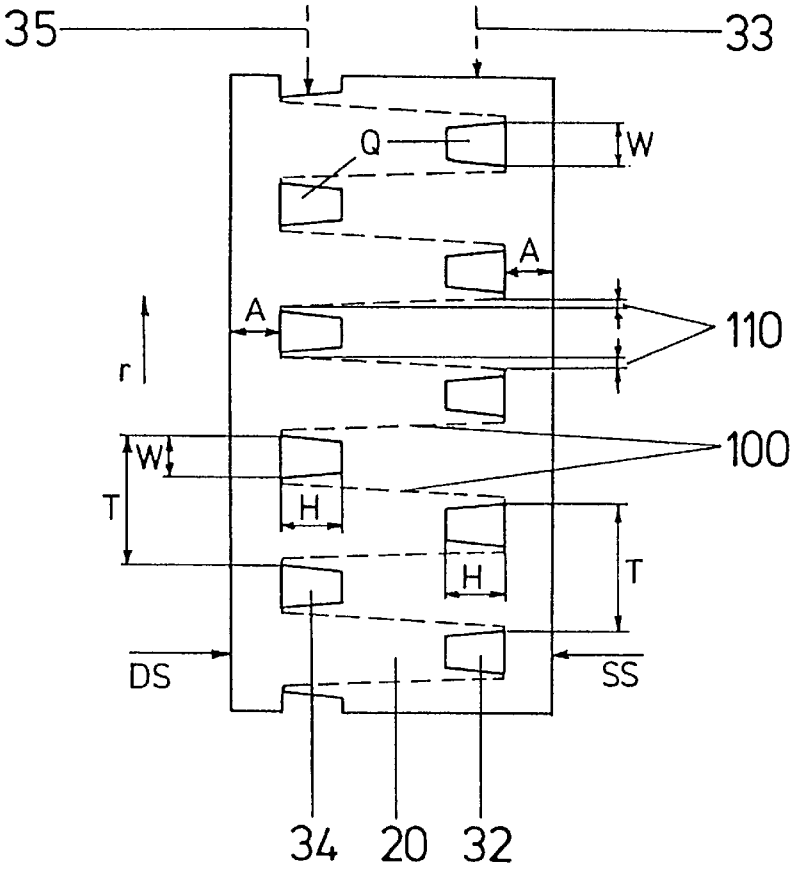
FIG. 2 shows a vane according to FIG. 1, section A—A, partial view.

The embodiment shown in FIG. 2 has a first row 33 of cooling channels 32 which is associated with the suction side SS, and a second row 35 of cooling channels 34 associated with the pressure side DS.

The cooling channels 32, 34 are trapezoid in this cross-section Q, whereby the long baseline defines the maximum width W of the respective cooling channel 32, 34, and the vertical height defines the maximum height.

The cooling channels 32, 34 each are arranged so that the side with the maximum width W is oriented in each case outward, i.e., directly adjoining the suction side SS or pressure side DS. The cooling channels 32, 34 are moved close to a distance A toward the surface (i.e., toward the suction side SS or pressure side DS), resulting in an optimum thermal transfer from the respective surfaces to the cooling channels 32, 34.

The cooling channels 32, 34 each are arranged equidistant from the pitch T. In the exemplary embodiment, the pitch T is the same fot both rows 33, 35, and is not locally varied in the radial direction r.

The cooling channels 32 of the first row 33 are furthermore arranged radially offset in relation to the cooling channels 34 of the second row 35, in each case by an amount of half the pitch T, so that the cooling channels 32, 34 each are oriented centered between two opposing cooling channels 32, 34. Such an arrangement is the basic prerequisite for realizing a core for the production of the cooling channels 32, 34 with casting technology. A further basic condition that must be observed is that the sum of the maximum width W of two opposing cooling channels 32, 34 is smaller than the local pitch T. This makes it possible to create a dividing plane 100 for a core form tool (not shown here), whereby the dividing plane 100 can be realized with a taper angle 110, which is absolutely necessary for separating the form.

This condition is met in the same manner for the embodiments according to FIGS. 3 to 7, so that these also can be produced with casting technology.

Figure 3:
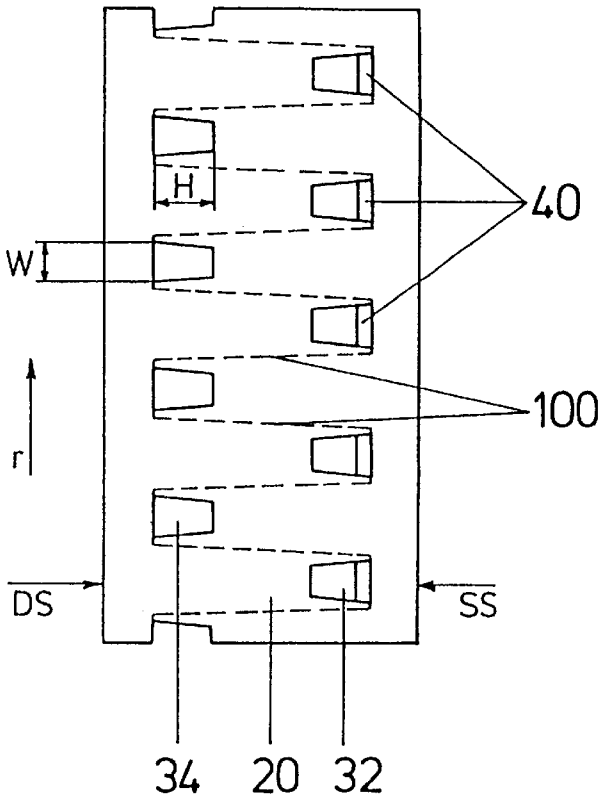
FIG. 3 shows a vane analog to FIG. 2 with turbulence generators.

The embodiment shown in FIG. 3 differs from the one in FIG. 2 in that the cooling channels 32 are provided with ribs 40. The ribs 40 are turbulence generators for the cooling medium flowing through them, and in this way improve the heat input into the cooling medium. This arrangement accounts for the fact that the suction side SS is subject to a higher thermal stress, thus resulting in a higher cooling requirement on this side. The cooling channels 34 associated with the pressure side DS in contrast are not provided with any additional structures, since the heat input there is smaller. Furthermore, in accordance with the previous exemplary embodiment, the ratio of maximum height H to maximum width W is approximately 1.25:1, resulting in an almost ideally even temperature distribution within the cooling channels 32, 34.

Figures 4, 5, 6:
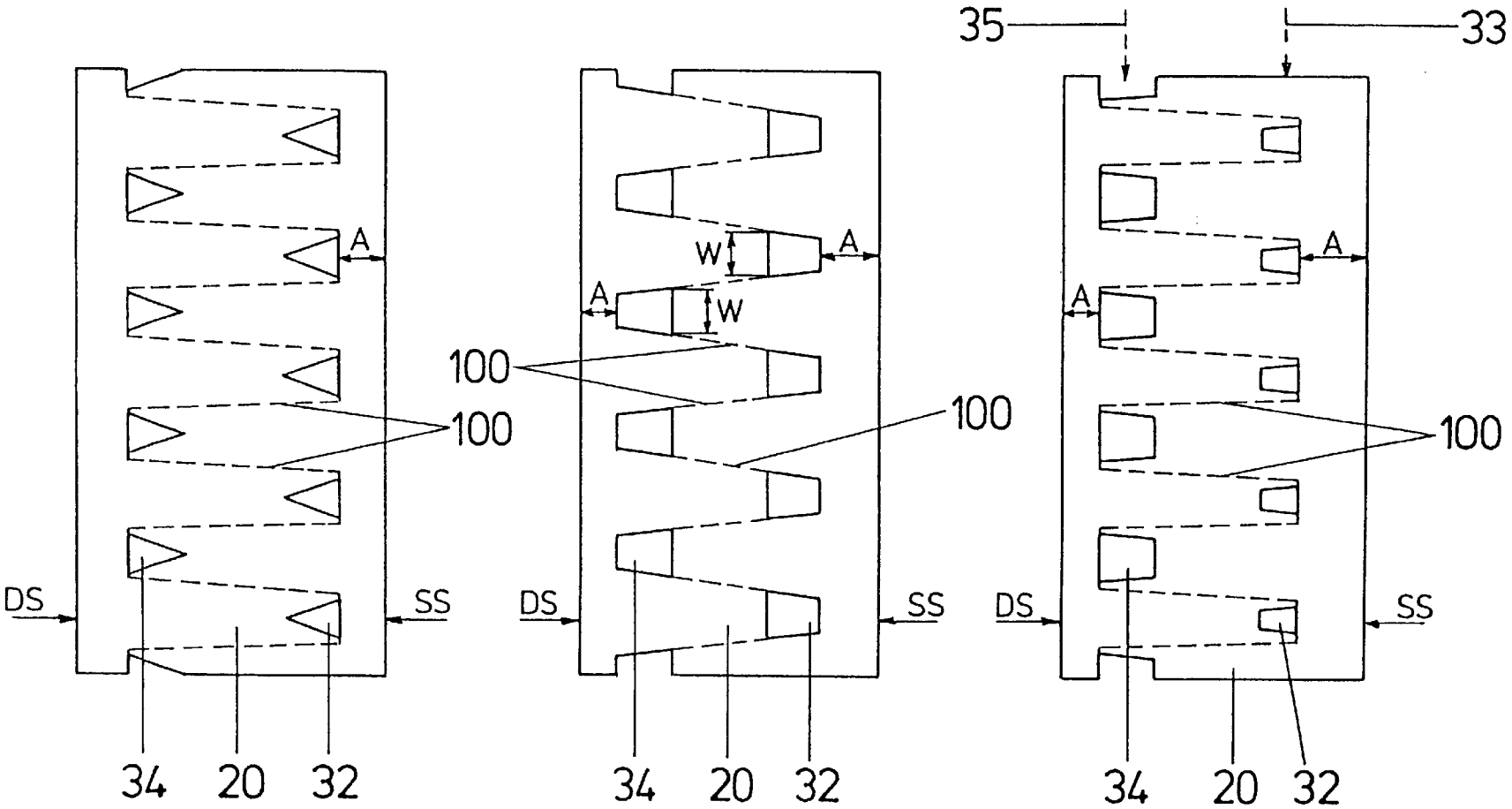
FIG. 4 shows a vane analog to FIG. 2, triangular cooling channels.
FIG. 5 shows a vane analog to FIG. 2, vane channels with trapezoid cross-section form.
FIG. 6 shows a vane analog to FIG. 2, cooling channels with varied cross-section area.

The embodiment shown in FIG. 4 has cooling channels 32, 34 in a triangular shape which have similar cooling power as those in the variation shown in FIG. 2, in spite of a reduced cross-section shape. In this embodiment, the cooling air is additionally passed toward the wall, since the flow resistance is high in the acute angle of the triangular channel.

In the embodiment shown in FIG. 5, the cooling channels 32, 34 are shown in the opposite direction from that shown in FIG. 2, i.e., the side with the maximum width W is oriented toward the center of vane section 20. Although this type of arrangement is not as advantageous in terms of thermal technology, it is used in instances where an especially low-cost production is critical. This variation permits a very simplified construction of the core form tool, since the dividing plane 100 can be designed so as to be in true alignment with the channel side walls. This embodiment also can be used if the thermal stress from the outside is smaller on the pressure side than on the suction side.

According to FIG. 6 it is provided that the cooling channels 32 are designed with a smaller cross-section area. In addition, the wall distance A is greater than that of the opposing row 35. This makes it possible to match the cooling power exactly with a different heat input in order to achieve an even temperature distribution in the trailing edge section 20.

Figure 7:
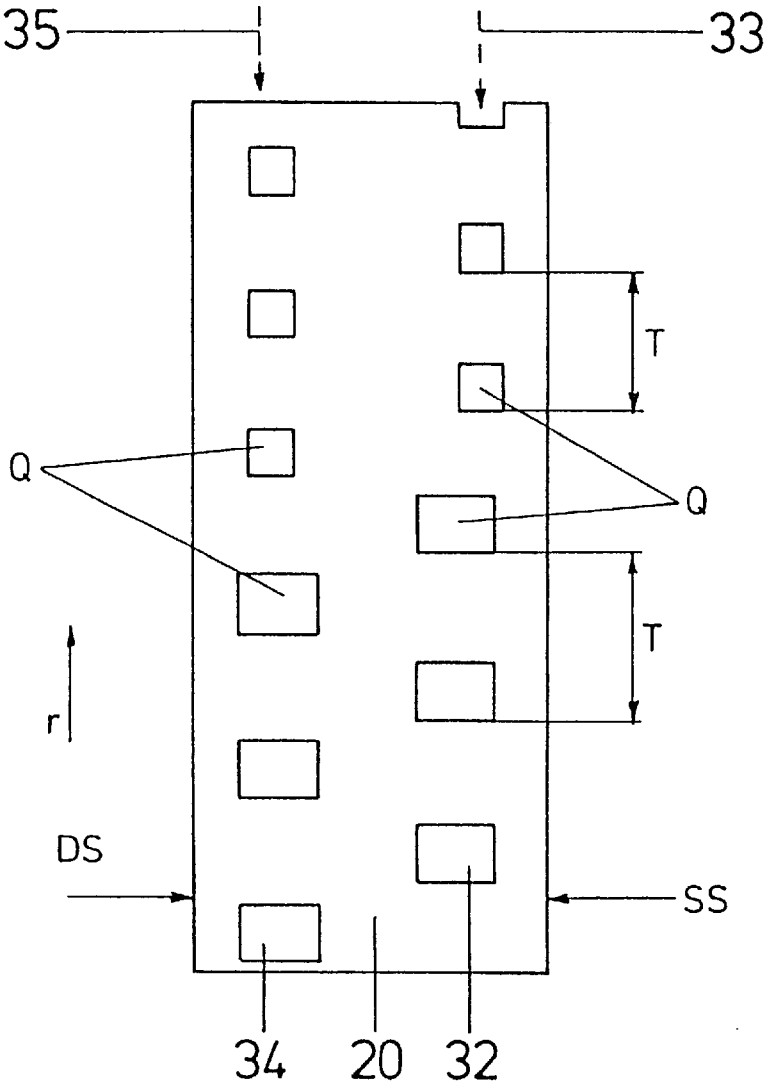
FIG. 7 shows a vane analog to FIG. 2, arrangement of the cooling channels with locally varied pitch.

The embodiment according to FIG. 7, in which the temperature gradients that exist in the radial direction r are supposed to be offset, has a similar objective. On the one hand, this is achieved by varying the cross-section areas Q within each of the respective rows 33, 35 and locally changing the pitch T. With a suitable adjustment an almost ideally even temperature distribution can be achieved within the vane section 20.

Figure 8:
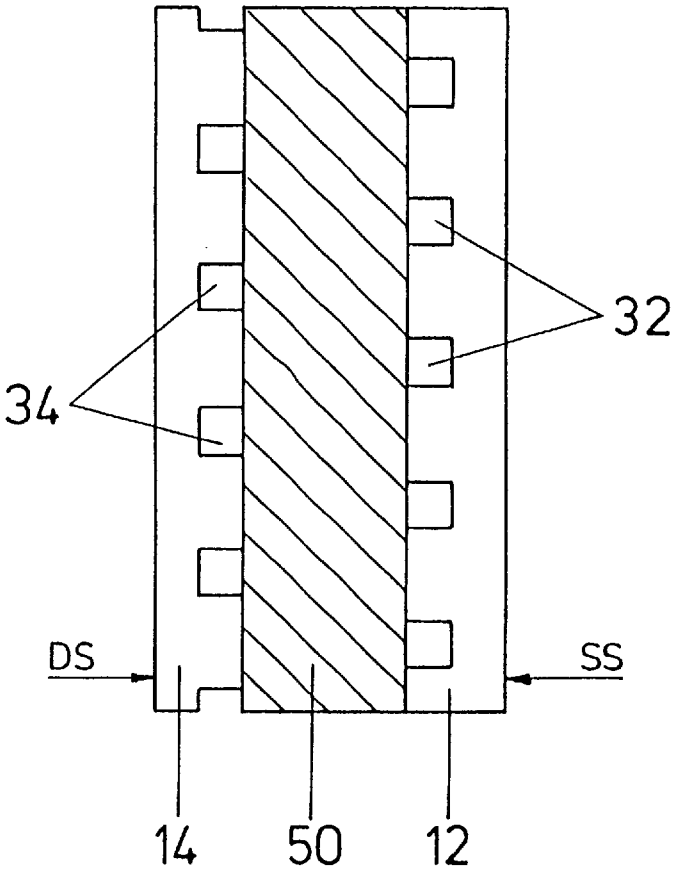
FIG. 8 shows a vane analog to FIG. 2 with a dividing body.

The embodiment according to FIG. 8 differs in essence from the previous one in that the cooling channels 32, 34 are molded as grooves into the suction side wall 12 and the pressure side wall 14 and are terminated by a tightly inserted dividing body 50. The dividing body 50 is produced from an insulating plastic material, for example polytetrafluorethylene or a ceramic material, preventing a direct heat transfer from the suction side wall 12 to the pressure side wall 14. Naturally, it is also possible to use another suitable insulating material. By replacing the center vane material with a dividing body, the thermally induced tension forces can be clearly reduced by the cold center area and the essentially hot wall surfaces. This is very advantageous for the life of the components. Compared to a construction entirely produced by casting, this may also result in weight advantages.

Only those elements essential for understanding the invention have been shown. For reasons of clarity, the sectioned surfaces of the vane are not shown striated.

Key to Drawings

1 Vane
10 Vane blade
12 Suction side wall
14 Pressure side wall
16 Leading edge
18 Trailing edge
20 Vane section, trailing edge section
30 Cavity
32 Cooling channel
33 Row
34 Cooling channel
35 Row
40 Rib
50 Dividing body
100 Dividing plane
110 Taper angle
r Radial direction
A Wall distance
H (Maximum) height
Q Cross-section area
T Pitch
W (Maximum) width
DS Pressure side
SS Suction side

What is claimed is:

1. A cooled vane for a gas turbine or similar device including a vane blade comprising:

a suction side wall and a pressure side wall that are connected with each other through a leading edge and a trailing edge and forming a cavity extending in a radial direction through which a cooling medium is capable of flowing;

a vane section formed by sections of the suction side wall and the pressure side wall and adjoining the trailing edge;

a plurality of cooling channels which start at the cavity and extend through the vane section and end at the trailing edge, the plurality of cooling channels including a first row of cooling channels adjacent the suction side wall and a second row of cooling channels adjacent the pressure side wall; and wherein the cooling channels of the first row are arranged laterally offset in the radial direction relative to the cooling channels of the second row, and wherein the cooling channels have a triangular or trapezoidal cross-section.

2. The cooled vane as claimed in claim 1, wherein the spacing between adjacent cooling channels of the first row and the spacing between adjacent cooling channels of the second row are identical, and the cooling channels of the second row each are radially offset from each of the cooling channels of the first row by an amount corresponding to half of the spacing between adjacent cooling channels of the first row.

3. The cooled vane as claimed in claim 2, wherein a sum of maximum width of two opposing cooling channels is smaller than the spacing of adjacent cooling channels of the first and second row of cooling channels.

4. A cooled vane for a gas turbine or similar device including a vane blade comprising:

a suction side wall and a pressure side wall that are connected with each other through a leading edge and a trailing edge and forming a cavity extending in a radial direction through which a cooling medium is capable of flowing;

a vane section formed by sections of the suction side wall and the pressure side wall and adjoining the trailing edge;

a plurality of cooling channels which start at the cavity and extend through the vane section and end at the trailing edge, the plurality of cooling channels including a first row of cooling channels adjacent the suction side wall and a second row of cooling channels adjacent the pressure side wall;

wherein the cooling channels are arranged so that a maximum width of each cooling channel is oriented outward and directly adjoining one of the suction side of the vane blade; and wherein a ratio of a maximum width of each cooling channel is in the range from 1.5 to 1.0:1.

5. The cooled vane as claimed in claim 4, wherein at least one of the cooling channels is provided with a turbulence generator.

6. The cooled vane as claimed in claim 5, wherein the turbulence generator is a rib.

7. A cooled vane for a gas turbine or similar device including a vane blade comprising:

a suction side wall and a pressure side wall that are connected with each other through a leading edge and a trailing edge and forming a cavity extending in a radial direction through which a cooling medium is capable of flowing;

a vane section formed by sections of the suction side wall and the pressure side wall and adjoining the trailing edge;

a plurality of cooling channels which start at the cavity and extend through the vane section and end at the trailing edge, the plurality of cooling channels including a first row of cooling channels adjacent the suction side wall and a second row of cooling channels adjacent the pressure side wall; and wherein the spacing between adjacent cooling channels of at least one of the rows of cooling channels varies in the radial direction.

8. A cooled vane for a gas turbine or similar device including a vane blade comprising:

a suction side wall and a pressure side wall that are connected with each other through a leading edge and a trailing edge and forming a cavity extending in a radial direction through which a cooling medium is capable of flowing;

a vane section formed by sections of the suction side wall and the pressure side wall and adjoining the trailing edge;

a plurality of cooling channels which start at the cavity and extend through the vane section and end at the trailing edge, the plurality of cooling channels including a first row of cooling adjacent the suction side wall and a second row of cooling channels adjacent the pressure side wall; and wherein the cooled vane is produced by a casting process, whereby the cooling channels are formed by a one-piece core that is removed after casting.

9. A cooled vane for a gas turbine or similar device including a vane blade comprising:

a suction side wall and a pressure side wall that are connected with each other through a leading edge and a trailing edge and forming a cavity extending in a radial direction through which a cooling medium is capable of flowing;

a vane section formed by sections of the suction side wall and the pressure side wall and adjoining the trailing edge;

a plurality of cooling channels which start at the cavity and extend through the vane section and end at the trailing edge, the plurality of cooling channels including a first row of cooling channels adjacent the suction side wall and a second row of cooling channels adjacent the pressure side wall; and wherein the cooling channels are formed at least in section by grooves in the suction side wall and in the pressure side wall and by a dividing body inserted between the suction side wall and the pressure side wall, and wherein the dividing body is formed of an insulating material.

10. A cooled vane for a gas turbine or similar device including a vane blade comprising:

a suction side wall and a pressure side wall that are connected with each other through a leading edge and a trailing edge and forming a cavity extending in a radial direction through which a cooling medium is capable of flowing;

a plurality of cooling channels which start at the cavity and extend through the vane section and end at the trailing edge, the plurality of cooling channels including a first row of cooling channels adjacent the suction side wall and a second row of cooling channels adjacent the pressure side wall; and wherein the cross-sectional area of at least one of the rows of cooling channels in one of the rows of cooling channels is less than the cross-sectional area of another cooling channel in the same row.

* * * * *